United States Patent [19]

Holce

[11] 4,210,889

[45] Jul. 1, 1980

[54] MAGNETICALLY ACTUATED SENSING DEVICE

[76] Inventor: Thomas J. Holce, 10905 SW. 5th #250, Beaverton, Oreg. 97005

[21] Appl. No.: 926,442

[22] Filed: Jul. 20, 1978

[51] Int. Cl.[2] ..... H01H 36/00

[52] U.S. Cl. ..... 335/207; 335/206

[58] Field of Search ..... 335/207, 206, 205, 153, 335/152

[56] References Cited

U.S. PATENT DOCUMENTS

| | | | |
|---|---|---|---|
| 2,912,540 | 11/1959 | Sawicki | 335/207 |
| 3,668,579 | 6/1972 | Harman | 335/207 |

*Primary Examiner*—Harold Broome

*Attorney, Agent, or Firm*—Chernoff & Vilhauer

[57] ABSTRACT

A magnetically-actuated sensing device for use in security monitoring systems. A switch unit having a plurality of electrically interconnected magnetic reed switches disposed in a predetermined physical relationship is provided for controlling electrical circuits. Each reed switch is biased in a magnetically-actuated state by permanent biasing magnet in close proximity thereto, the biasing magnets being arranged in a predetermined combination of polarity orientations. A corresponding number of permanent actuating magnets with polarity orientators opposing those of the biasing magnets are disposed within an actuating unit so that they overcome the effect of the biasing magnets when the switch unit and actuating unit are in a predetermined physical relationship with each other. The polarity of at least one of the biasing magnets opposes the polarity of other biasing magnets of the device, providing a sensing device which cannot be deceived using only a single permanent magnet to simulate the actuating magnets. Single-pole-double-throw reed switches may be used to give positive signals corresponding to both alignment and misalignment of the actuating unit with the switch unit. Magnetic shielding associated with the switches and actuating magnets allows the device to be factory-adjusted and sealed, and thereafter to be used in environments containing magnetic material without further adjustment.

10 Claims, 12 Drawing Figures

MAGNETICALLY ACTUATED SENSING DEVICE

BACKGROUND OF THE INVENTION

This invention relates to improvements in magnetically actuated sensing devices for monitoring the opening or closing of doors or windows or the like as a part of an electrically monitored physical security system.

Magnetically actuated switches previously used in physical security monitoring systems have typically utilized a magnetically actuated reed switch mounted, for example, in the frame of a doorway or window, with conductors leading therefrom to a security system control unit, and one or more magnets mounted on the edge of the door or window for actuating the reed switch. When the actuating magnet approaches the reed switch within a certain distance, determined by the sensitivity of the reed switch and the strength of the actuating magnet, the magnet actuates the reed switch by closing a set of magnetic contacts therein, which sends an electrical signal to a control unit.

In such applications it is desirable to utilize a relatively sensitive switch so that the distance between the switch and its actuating magnet necessary to actuate the switch is not critical, thereby permitting slight variations in the position of the magnet without changing the state of the switch and setting off a false alarm. A previously known improvement on such magnetically-actuated reed switches for increasing their sensitivity uses a small permanent magnet placed close to a reed switch to bias the response of the switch to the presence of an external magnetic field, so that a weaker magnetic switch field is required to actuate the magnet. Adjustable biasing may be achieved, for example, by variation of the distance or angular relationship between the magnet and the longitudinal axis of the reed of a switch, as shown in Nicholls U.S. Pat. No. 3,974,469, and by varying the location of the reed along an imaginary axis parallel to the axis of polarity of the biasing magnet, as shown by Tann U.S. Pat. No. 3,305,805. An example of a previously known switch using a biasing permanent magnet in proximity to a reed switch is the model MDS-B switch manufactured by the Potter Electric Signal Co. of St. Louis, Mo. In that device a movable actuating magnet is oriented in magnetic opposition to a biasing magnet located near a reed switch such that the biasing magnet improves the sensitivity of the switch.

Another desirable feature of switches used in security systems is resistance to manipulation or deception by the use of foreign magnetic fields. High-security switches known as "balanced" switches have been developed for this purpose. An example of this "balanced" type of switch device is the model DR-850 switch manufactured by Walter Kidde & Co. of Belleville, N.J. which has two single-pole-double-throw reed switches and a biasing magnet associated with one of them. An actuating permanent magnet is provided whose position is adjustable within its housing so that when properly adjusted the reed switches will be operated to produce a "normal" indication. However, any attempt to defeat the system with an externally applied magnet, regardless of its field direction, is alleged to upset the balance of the switches and thereby produce an "abnormal" indication. Such "balanced" high-security switches, however, must be carefully adjusted during their installation to provide proper actuation.

Adjustment of the position of the actuating magnet relative to the switch is critical in the prior art devices adapted for use in security systems, and when seasonal changes in air temperature and humidity cause changes in the alignment of a door to its frame minor misalignment is often sufficient to cause the device to produce false indications, requiring expensive service calls for realignment of the switch and its actuating magnet.

Additionally the prior art devices require further adjustment for use in environments including significant amounts of magnetic material, as when they are mounted on steel doors and doorframes, and covers on such devices that are removable for performing such adjustments therefore also require security devices such as tamper detection circuits. None of the aforedescribed prior art devices solves all of the problems confronting security devices in an entirely satisfactory manner.

Accordingly, a switch is needed which is difficult to deceive using additional magnets, and which remains sensitive to opening of the door or window that it monitors without the necessity for adjustment or access to internal components.

SUMMARY OF THE INVENTION

The present invention overcomes the disadvantages of prior art security switches by providing a magnetically actuated sensing device which is factory-adjusted for optimum sensitivity and requires no in-service adjustment under normal conditions. The device of the invention is also resistant to tampering and to intruders' attempts at manipulation by the use of magnets to simulate the actuating unit.

The sensing device of the invention comprises a switch unit in which a plurality of reed switches are arranged side by side, parallel to each other, within a switch housing. A small biasing permanent magnet is mounted in close proximity to each reed switch, with its axis of polarity, that is, an imaginary line connecting its magnetic poles, substantially parallel to the reed of the reed switch. The biasing magnets are preferably placed so that at least one is oriented in opposing polarity to the others, and the switch unit is adjusted by moving each biasing magnet along the longitudinal axis of its particular reed switch to a position where the switch is magnetically closed, that is, until a magnetic reed of the switch is attracted into minimum contact with a magnetic fixed contact.

The switch unit is operated by an actuating unit comprising a combination of permanent actuating magnets arranged side by side with their axes of polarity parallel to one another, and spaced apart from each other by distances corresponding to the spacing between the reed switches of the switch unit. The individual permanent magnets of the actuating unit oppose the polarities of their corresponding biasing magnets of the individual reed switches, thereby causing the reed switches to be released from magnetic closure when the actuating unit is brought close enough to the switch unit. Where the axis of polarity of one biasing magnet is opposite in orientation to that of another, a single magnet is incapable of simulating the influence of the actuating unit since oppositely oriented magnetic fields are required to oppose the respective biasing magnets of the individual reed switches.

The reed switches are mounted on a common base plate, which is in turn mounted parallel to a magnetically permeable metal shield plate. The magnetic metal shield acts as a path for the magnetic circuit and thus allows the switch to be factory-adjusted and thereafter to be installed without the necessity of field adjustment to compensate for additional magnetic material in the area where the device is installed.

The reed switches are normally of the single-pole-double-throw type, with a first switch position, or state, providing a closed circuit when the actuating magnet is in its normal, actuating relationship with the switch unit, and a second switch position providing a separate closed circuit when any one or more of the magnetic reed switches is magnetically closed by its biasing magnet because the actuating magnet is not in its normal position. Accordingly, the switch unit may be wired to provide a closed circuit for a control or alarm unit either when the switch unit is actuated or when it is not actuated, or under both circumstances.

As yet a further measure of security against tampering and the like, a third circuit, called a supervised loop, runs through the switch unit to monitor security system circuit continuity. The interruption of current in the supervised loop circuit, should anyone attempt to disable the device of the invention by cutting its cable, provides yet another signal to the security system control and alarm unit.

In a preferred embodiment of the switch of the invention, three magnetic reed switches are used, and the biasing magnets associated with the two outer reed switches are aligned with like polarity orientation while the center biasing magnet is placed opposing the polarity of the outer two magnets. Additional security may be provided in a sensing device by increasing the number of reed switches and varying the combinations of biasing magnet polarity orientation, thereby coding the switch unit.

The switches and the actuating magnets of the invention are fixed in potting material and contained in protective metal housings which provide an additional measure of security against tampering. Each housing includes a magnetic metal shield which not only protects the sensing device from the influence of magnetic material in the area of installation, but makes it more difficult to determine the location and orientation of the actuating magnets in their housing. The housings also provide means for mounting the switch unit and the actuating unit of the invention, and include a terminal for a protective cable for the conductors leading from the switch unit to the security system control unit.

In one embodiment of the invention the housings comprise aluminum tubes which are fastened to non-magnetic stainless steel mounting plates which fit concealed within standard size cut-outs for latches and the like in steel door frames and fire doors.

Therefore it is a principal objective of the present invention to provide an improved magnetically actuated sensing device for use in a physical security system monitoring circuit.

It is a further objective of the sensing device of the present invention that it cannot readily be defeated by the use of foreign magnetic fields.

It is an additional objective of this invention to provide a magnetically-actuated security switch which may be easily installed without further adjustment of the components thereof.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
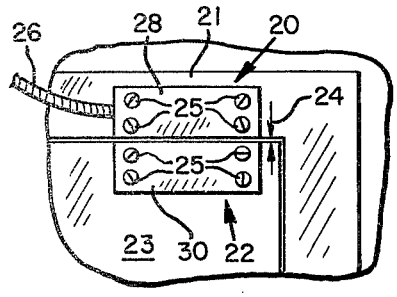
FIG. 1 illustrates a typical installation of a magnetically actuated sensing device according to the present invention.

Referring to FIG. 1, a switch unit 20 and an actuating unit 22 of the magnetically actuated sensing device of the present invention are shown in a typical installation in which the switch unit is mounted on a doorway frame 21 and the actuating magnet unit is mounted on a door 23, in alignment with the switch unit. The switch unit and actuating unit may be secured in place by the use of fasteners such as screws 25. The actuating unit 22 is separated from the switch unit 20 by a gap 24, and a cable 26 leads from the switch unit 20 to a security system control and alarm unit (not shown). It will be appreciated that the gap 24 may vary depending on the installation of the door within its frame, and that therefore, it is desirable to have a sensing device which is operable even when the gap is of an appreciable size. If the maximum actuation gap, that is, the greatest distance between the switch unit and actuating unit at which the actuating unit will actuate the switch unit, is too small, minor variations in the distance between the switch unit and the actuation unit caused, for instance, by weather variations, wear of door hinges, or vibration of the door by wind or machinery operation, can cause false indications of security violations and require repositioning the sensing device.

Figure 2:
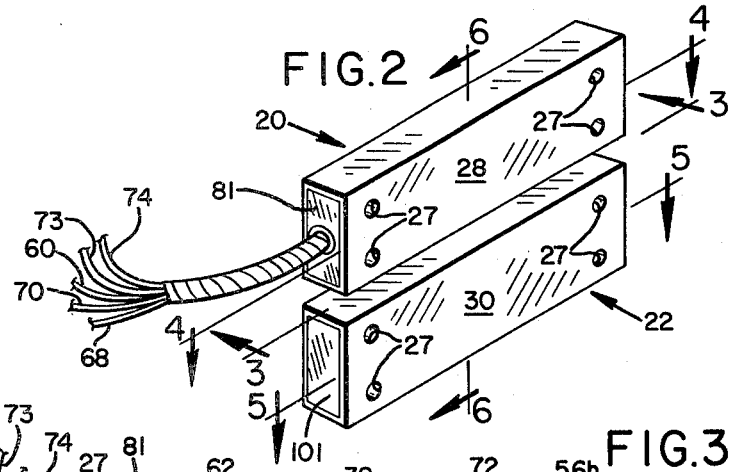
FIG. 2 is a perspective view of a sensing device according to the invention.

Referring to FIG. 2, it may be seen that in one exemplary embodiment the switch unit and the actuating unit respectively include a protective switch housing 28 and a similar actuating unit housing 30, both of which are tubular in cross-section. The housings are preferably manufactured of aluminum, since it is easily worked and relatively maintenance-free.

Turning to FIGS. 3-6, the switch unit basically comprises a non-magnetic base plate 32, a clip 34 adhesively attached to the base plate near one end thereof, the clip having a flat base portion 36 and a pair of clamping arms 38 extending therefrom, a magnetic reed switch 40, of the single-pole-double-throw type, held by the clamping arms 38 which partially encircle it, and an elongate biasing magnet 58 attached to the side of the capsule. (A fast-setting adhesive such as that marketed by the Eastman Kodak Co. of Rochester, N.Y. under the trademark EASTMAN 911 has been found particularly suitable for attaching the clip to the base and the biasing magnet to the capsule, and for similar attachments in the invention.)

Figure 7:
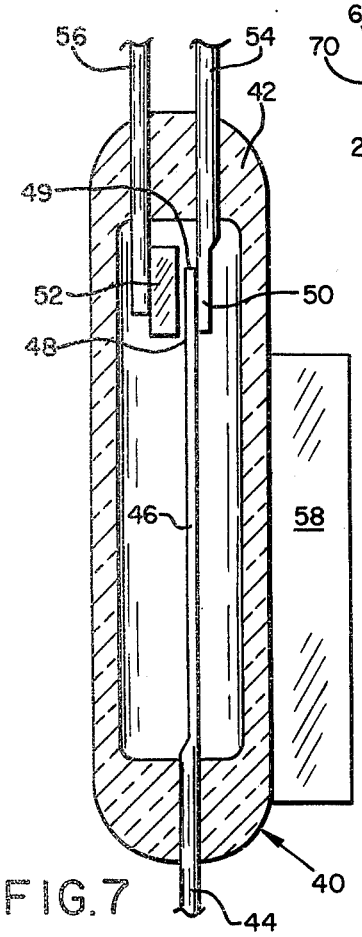
FIG. 7 is a sectional view of a magnetic reed switch of a type which may be used in a switch unit according to the invention.

The reed switch, shown in greater detail in FIG. 7, comprises a cylindrical glass capsule 42 enclosing and supporting the operative components of the switch. One end of a magnetic reed 46, which is an elongate flexible strip of a highly permeable ferromagnetic metal of low retentivity such as a 50% nickel and 50% iron alloy, is fixedly attached to a reed conductor 44 and extends therefrom toward the opposite end of the capsule. The free end 48 of the reed comprises a reed-carried contact 49 which is located between a magnetic fixed contact 50 and a non-magnetic fixed contact 52. A magnetic conductor 54, connected to the magnetic fixed contact, and a non-magnetic conductor 56, connected to the non-magnetic fixed contact, extend outwardly through the glass capsule 42 at the end thereof opposite the reed conductor 44. The flexible reed 46 is self-biased by its own elasticity toward a position whereby the reed-carried contact 49 is in electrical contact with the non-magnetic fixed contact 52.

The elongate biasing magnet 58, which may, for example, be made of alnico V or alnico VIII, is located adjacent to and parallel with the reed 46 and has a longitudinally oriented axis of polarity, that is, an imaginary line connecting the magnetic poles. The biasing magnet is adhesively fixed in a position adjusted longitudinally along the reed switch such that its magnetic field causes the reed-carried contact 49 and the magnetic fixed contact 50 to be attracted to each other, thereby separating the free end 48 and reed-carried contact 49 from the non-magnetic fixed contact 52, and creating electrical contact between the reed-carried contact 49 and the magnetic fixed contact 50.

Preferably at least two additional similar magnetic reed switches **40*a* and 40*b* are located parallel to the reed switch 40 at respectively the center and the further end of the base plate 32. These switches are similarly held in clips 34*a* and 34*b*, and have biasing magnets 58*a* and 58*b* similarly attached thereto. The polarity orientation of the biasing magnet 58*b* is identical to that of the biasing magnet 58, and the polarity orientation of the biasing magnet 58*a* is opposite to that of the biasing magnets 58 and 58*b***. The use of three or more reed switches necessitates the use of more than one permanent magnet to actuate the switch unit, making more difficult any attempt to defeat the device by simulation of the actuating unit using foreign magnetic fields.

Figure 8:
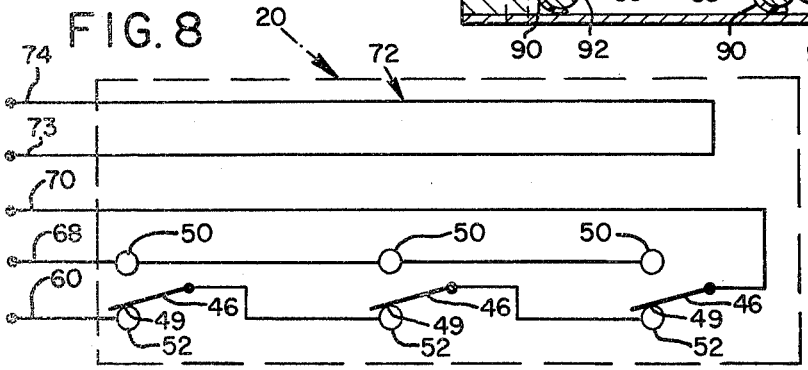
FIG. 8 is a schematic diagram of a sensing device according to the present invention.

Referring to FIG. 8, a closed loop conductor 60 is electrically connected to the magnetic conductor 54, extending therefrom through an aperture 62 in the base plate 32 and to the cable 26, which leads, for example, to a security system control and alarm unit (not shown). A first intermediate conductor 64 interconnects the reed conductor 44 of switch 40 and a magnetic conductor **54*a* of switch 40*a*. Similarly, a second intermediate conductor 64*a* interconnects a reed conductor 44*a* of switch 40*a* to a magnetic conductor 54*b* of switch 40*b*, so that the three switches are connected in series by one side each thereof. A tie bar 66 interconnects non-magnetic conductors 56, 56*a* and 56*b* of the reed switches so that the switches are connected in parallel by the second side each thereof, and an open loop conductor 68 is connected to the tie bar 66 and extends therefrom through the aperture 62 and the cable 26. A common conductor 70 is connected to the reed conductor 44*b* of magnetic reed switch 40*b* and extends through a second aperture 71 and the cable 26**.

A supervised loop 72, formed by interconnecting a first conductor 73 and a second conductor 74 which extend through the aperture 71 and the cable 26 for connection to the security system control and alarm unit, is placed below the base plate 32, thereby providing a means for monitoring the integrity of the alarm system wiring. Should an intruder attempt to defeat the alarm system by severing the cable or the switch unit, the discontinuity created in the supervised loop would be sensed by the security system control unit.

Figure 4:
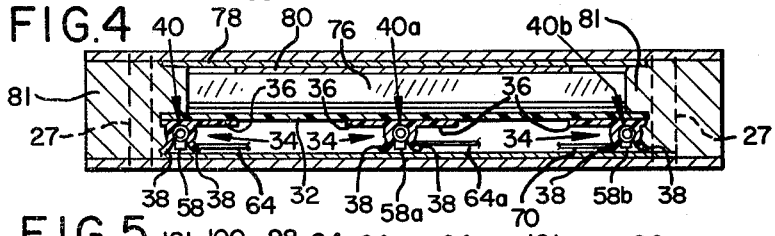
FIG. 4 is a sectional view of the switch unit shown in FIG. 2, taken along line 4—4.
Figure 5:
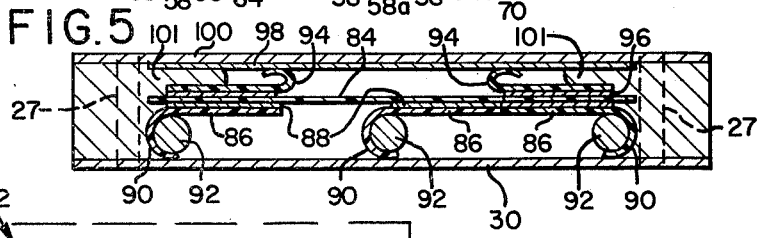
FIG. 5 is a sectional view of an actuating magnet portion of the sensing unit shown in FIG. 2, taken along line 5—5.
Figure 6:
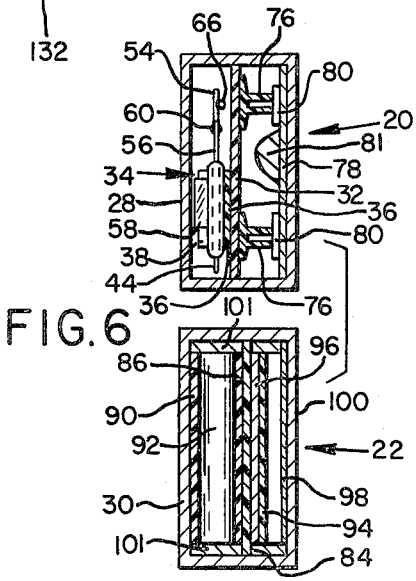
FIG. 6 is a sectional view of the sensing device shown in FIG. 2, taken along line 6—6.

As seen in FIGS. 4 and 6, a pair of non-magnetic spacer rails 76 are adhesively fixed to the opposite side of the base plate 32, and a magnetic shield 78, comprising a magnetically permeable sheet of mild steel substantially equal in size to the base plate 32, is adhesively attached to the spacer rails 76, preferably by means of double-faced adhesive tape 80. The magnetic shield 78, located on the mounting side of the switch unit provides a sufficient amount of nearby magnetic material to make negligible the effect on switch operation of steel doors and doorways in the area of installation, thereby allowing the position of the biasing magnets 58, **58*a* and 58*b* to be adjusted and fixed during manufacture of the switch unit without further adjustment once the unit is installed. Since no further access to the reed switches is required once the biasing magnets have been adjusted and adhesively fixed in their proper positions, the entire switch unit housing 28 may be filled with an epoxy or room temperature vulcanizing potting material 81 which surrounds and restrains the interior components of the switch unit 20 and a cable socket 82 which attaches the cable 26** thereto, adding further resistance to tampering.

Figure 3:
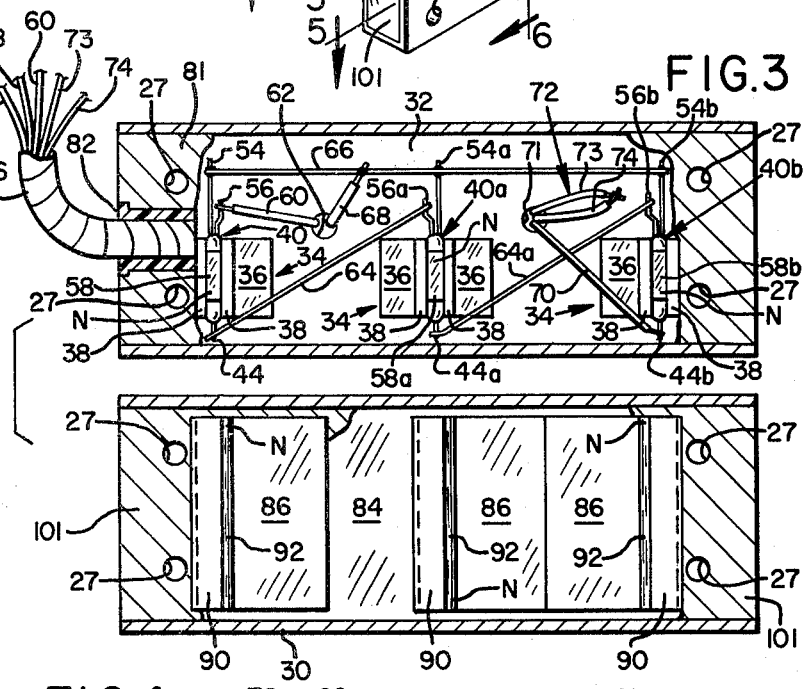
FIG. 3 is a sectional view of the sensing device shown in FIG. 2, taken along line 3—3.

The actuating unit 22 has an actuating unit housing 30, also shown in sectional view in FIG. 3. Within the actuating unit housing is a magnet mounting plate 84, of non-magnetic material, oriented parallel to the largest side of the housing. Three magnet holders 86 are adhesively attached to the magnet mounting plate 84, preferably by means of double faced adhesive tape 88. The magnet holders 86, which may be of plastic material, each comprise a curved partial-cylindrical portion 90 which resiliently grips an elongate actuating magnet 92 which, like the biasing magnets 58, is preferably made of alnico V or alnico VIII. The actuating magnets are thus located within the actuating unit housing 30 in alignment with the location of the magnetic switches 40, **40*a* and 40*b* within the switch unit housing 28. A pair of spacers 94 are attached, preferably by double faced adhesive tape 96, to the side of the magnet mounting plate 84 opposite the magnet holders 86. The spacers 94 hold a magnetic shield 98, similar in material and function to the magnetic shield 78, against a rear side 100 of the magnet unit housing. Like the switch unit housing, the actuating unit housing is filled with an epoxy or room temperature vulcanizing potting material 101** and hold the components thereof in their proper positions.

Figure 10:
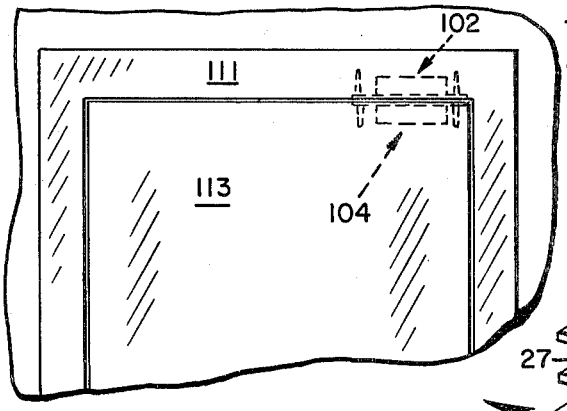
FIG. 10 illustrates a typical installation of the device shown in FIG. 9.
Figure 9:
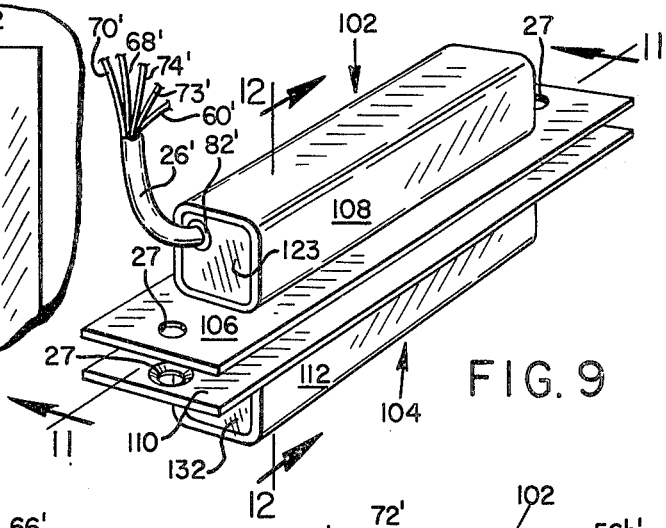
FIG. 9 shows an alternative sensing device according to the present invention.

Turning now to FIGS. 9 and 10, showing an alternative embodiment according to the invention, a switch unit 102 and an actuating magnet unit 104 are adapted to be concealably fitted into recesses in a door frame 111 and the edge of a door 113, as may be particularly desirable in a high-security door or a steel fire door application. Preferably the switch unit 102 comprises a mounting plate 106 of a non-magnetic metal such as stainless steel, and a switch housing 108 of tubular aluminum having an approximately square cross section, which is adhesively fixed to the switch unit mounting plate 106. The actuating unit 104 comprises an actuating unit mounting plate 110 and an adhesively attached actuating unit housing 112, which are similar to the switch unit mounting plate 106 and switch housing 108 respectively.

Figure 11:
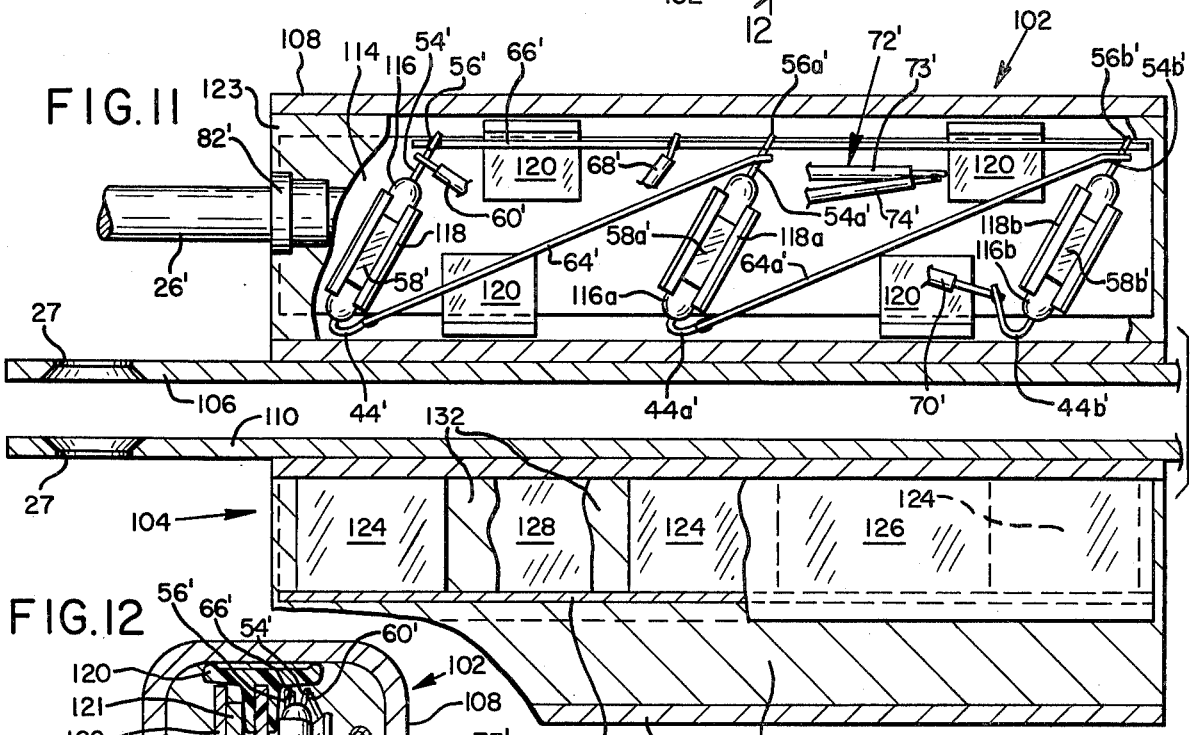
FIG. 11 is a sectional view of the sensing device shown in FIG. 9, taken along line 11—11.
Figure 12:
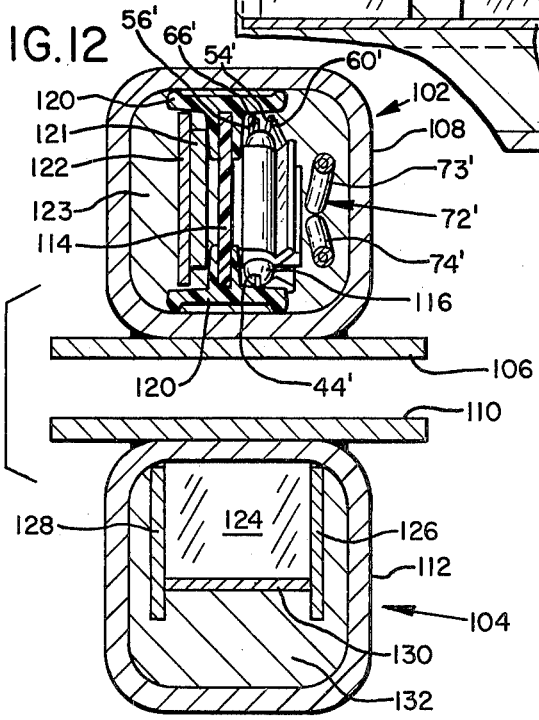
FIG. 12 is a sectional view of the sensing device shown in FIG. 8, taken along line 12—12.

Referring to FIGS. 11 and 12, the switch 102 comprises a non-magnetic base plate 114, to which three plastic clips 118, similar to the plastic clips 34 of the previously described embodiment of the invention, are adhesively attached, and three single-pole-double-throw magnetic reed switches 116 are held by the plastic clips 118. Four spacer clips 120, preferably of extruded plastic construction, fit slidingly upon the edge of the base plate 114, providing stablizing support for the base plate 114 within the housing 108.

A longitudinally polarized elongated biasing magnet 58' preferably made of alnico V or alnico VIII, is located adjacent the reed switch 116, within the clip 118, where, like the biasing magnet 58 of the above-described embodiment, the position of biasing magnet 58' is adjusted for appropriate sensitivity so that the magnet holds the reed switch 116 in its magnetically actuated position when the actuating unit 104 is not present. As in the above-described embodiment of the invention, the biasing magnet 58', once its position has been adjusted, is adhesively fixed in place.

In the center of the base plate 114 is a second reed switch **116*a* held by a clip 118*a* which is adhesively attached to the base plate 114, and at the far end of the base plate 114 is a third reed switch 116*b* held by a clip 118*b* similarly attached to the base plate. The reed switches 116*a* and 116*b* are accompanied by similarly located and adjusted biasing magnets 58*a'* and 58*b'*. As in the above-described embodiment of the invention, the biasing magnet 58*a'* is oriented in opposing polarity to the biasing magnets 58' and 58*b'***, which have the same polarity orientation.

An electrical conductor cable 26' passes through a cable socket 82' located at one end of the switch unit housing 108. A supervised loop 72', shown only partially, extends from conductors in the cable along the base plate 114. Like the previously-described switch 40, the reed switch 116 has a reed conductor 44', a magnetic conductor 54', and a non-magnetic conductor 56' connected to corresponding internal elements as in reed switch 40. A closed loop conductor 60' extends from the cable 26' and is connected to the magnetic conductor 54', a tie bar 66' is connected to a non-magnetic conductor 56', and an open loop conductor 68' extends from the cable 26', and is connected to the tie bar 66'. The reed conductor 44' is interconnected by an intermediate conductor 64' with a magnetic conductor **54*a'* of the reed switch 116*a*. Similarly, a reed conductor 44*a'* of the reed switch 116*a* is interconnected by a second intermediate conductor 64*a'* with a magnetic conductor 54*b'* of the magnetic reed switch 116*b*. The tie bar 66' is connected to non-magnetic conductors 56', 56*a'* and 56*b'* of the reed switches 116, 116*a* and 116*b* respectively, joining the three non-magnetic conductors in parallel. A common conductor 70' extends from the cable 26' and is connected to a reed conductor 44*b'* of the reed switch 116*b***. Thus the electrical connections of the present embodiment are the same as those of the previously described embodiment.

Located behind the base plate 114, and attached preferably by double-faced adhesive tape 121 to the spacer clips 120, is a magnetic shield 122, of dimensions similar to those of the base plate 114, which serves the same purpose as the magnetic shield 78 of the previously-described embodiment. After adjustment the switch unit components are surrounded with potting material 123.

Within the actuating unit 104, also shown in FIG. 10, three generally rectangular ceramic ferrite actuating magnets 124 are located. The magnets are spaced apart and aligned with the magnetic reed switches 116 when the actuating magnet unit is operatively aligned with the switch unit. The axis of polarity of each actuating magnet is perpendicular to a pair of faces and the magnets are located within the magnet housing 112 so that the polarity of each ceramic magnet approximately opposes that of the corresponding biasing magnet 58', although because of the slightly oblique alignment of the clips 118 the opposition is not precisely direct. Three rectangular sheet steel magnetic shield pieces 126, 128 and 130 are placed adjacent respective faces of each of the magnets 124, thereby providing a short magnetic circuit within the housing 112 and thus simulating an environment in which there is a large amount of nearby magnetic material, allowing the device to be used in an environment containing additional magnetic material without the need for adjustment of the switch unit at the installation site. The ceramic magnets and magnetic shield components, once located and positioned properly within the magnet housing 112, are fixed in place by potting material 132.

Referring again to the electrical circuits shown in FIG. 8, the reed switches are shown in the self-biased position in which the reed-carried contact 49 of each reed switch is in contact with its respective non-magnetic fixed contact 52, thus closing the series circuit between the common conductor 70 and the closed loop conductor 60. This is the normal state when the switch unit is properly installed and the door to which the actuating magnet unit is attached is in its normal position. If, however, the door is not in its proper position, or an attempt is made to defeat the sensing device without using a similar combination of magnets, one or more of the reeds 46 will be attracted to the magnetic contact 50 of its reed switch, thereby changing state. This may occur either because of an absence of a sufficiently strong magnetic field of opposite polarity to the biasing magnet associated with the particular reed switch, or because the magnet being used to simulate the actuating unit is so powerful that it completely overcomes the effect of the biasing magnet, thereby operating the reed switch. In either case, a break in the closed loop circuit will be caused by any single reed which is not in its spring-biased state whereby the reed-carried contact 49 electrically contacts the non-magnetic contact 52. Further, any reed which is magnetically attracted into contact with a corresponding fixed magnetic contact 50 will close the open-loop circuit between the open loop conductor 68 and common conductor 70, thereby causing a positive signal to the security system control unit.

The position of each individual biasing magnet 58 associated with a reed switch is adjusted by movement along the longitudinal dimension of its reed switch, that is, in a direction generally parallel to the reed thereof, from a position near the fixed end of the reed 46 toward the fixed contacts, until the switch is barely magnetically actuated. Thus, each reed switch is located in a magnetic field of strength just sufficient to cause magnetic operation and closure between the contacts 49 and 50. A comparatively weak magnetic field of opposing polarity is needed to overcome the effect of hysteresis on the switch, allowing the magnetic contacts 48 and 50 to separate and the reed 46 to be moved by its inherent spring bias to cause a circuit through the reed-carried contact 49 and the fixed contact 52. Accordingly, for a given size of magnet in the actuating unit, the gap 24 between the switch unit and actuating unit may be greater than is possible for a sensing device of this type without biasing magnets. This increased sensitivity which decreases the criticality of gap size enables the sensing device to be used reliably to monitor the closed position of doors which are subject to vibration in their secured state which would cause previously known magnetically actuated security sensing devices to give false indications. Additionally, for a given gap between the switch unit and the actuating magnet unit, smaller actuating magnets can be used, thus making it more difficult to determine the location and polarity of the individual actuating magnets.

In addition to allowing the switch to be adjusted during manufacture and installed without further adjustment, the magnetic shields 78, 98, 122, 126, 128 and 130 associated with the switch units and actuating magnet units of the sensing devices also make actuation of the switch more definite and crisp, since they concentrate the magnetic fields of the actuating magnets in the regions where they properly affect the switch unit.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A magnetically actuated sensing device for controlling an electrical circuit in a physical security monitoring system, said sensing device comprising:

(a) a switch unit having at least three electrically interconnected reed switches, each one of said reed switches being responsive to a respective predetermined magnetic flux density, presence of said respective predetermined flux density causing magnetic actuation of each respective one of said reed switches;

(b) a plurality of permanent magnet biasing means, one of said permanent magnet biasing means being located adjacent each one of said reed switches for providing said respective predetermined magnetic flux density surrounding each one of said plurality of reed switches, at least one of said plurality of permanent magnet biasing means being located so as to provide magnetic flux in substantial opposition to magnetic flux of at least one other of said plurality of permanent magnet biasing means; and (c) an actuating unit comprising means for allowing each one of said reed switches to assume a magnetically nonactuated state by reducing the net flux density surrounding each one of said plurality of reed switches sufficiently below said respective predetermined flux density when said actuating unit is in a predetermined position relative to said switch unit.

2. The sensing device of claim 1 wherein said actuating unit comprises a plurality of permanent magnet means for allowing said reed switches to assume a magnetically nonactuated state, each one of said permanent magnet means being oriented so as to reduce the net flux density surrounding a repective one of said reed switches when said actuating unit is located in a predetermined position with respect to said switch unit.

3. The sensing device of claim 1 further comprising magnetically permeable shield means located in proximity to said reed switches, and separate magnetically permeable shield means located in proximity to said actuating means, for shielding said device from the influence of magnetic material so that factory adjustment of said permanent magnet biasing means need not be altered when said sensing device is installed in proximity to magnetic materials.

4. The sensing device of claim 1 wherein each of said reed switches includes an elongate reed having a longitudinal dimension and each one of said plurality of permanent magnet biasing means comprises a small permanent magnet corresponding to one of said reed switches and having an axis of polarity oriented substantially parallel to the length of the elongate reed of the respective reed switch, the position of each said small permanent magnet being adjusted along the longitudinal dimension of the elongate reed of the respective reed switch to a position where said small permanent magnet is barely able to cause magnetic actuation of said respective reed switch.

5. The sensing device of claim 1 wherein the ones of said plurality of permanent magnet biasing means have axes of polarity, said axes of polarity being oriented relative to one another in a predetermined coded combination.

6. The sensing device of claim 1 wherein said reed switches are elongate and located parallel to one another, and the respective ones of said plurality of permanent magnet biasing means associated respectively with adjacent reed switches have respective axes of polarity which are magnetically opposed to one another.

7. The sensing device of claim 1 including a switch unit housing and an electrical cable and having supervised loop circuit means located within said housing and electrical cable for providing indication of tampering with said device.

8. The sensing device of claim 1 wherein each of said reed switches is a single pole double throw switch having a magnetic contact side and a non-magnetic contact side, said sensing device including connection means electrically interconnecting said reed switches with said magnetic contact sides in series and said non-magnetic sides in parallel.

9. The sensing device of claim 1 wherein said switch unit further comprises a base plate and a plurality of clip means for attaching said reed switches and permanent magnet biasing means to said base plate, each said clip means having a base and an attached pair of arms for resiliently gripping around one of said reed switches, said arms defining an open space between the ends thereof for receiving one of said permanent magnet biasing means, and wherein said actuating means further comprises an actuating magnet base plate and magnet holder means for attaching a plurality of actuating magnets to said actuating magnet base plate.

10. The sensing device of claim 1 wherein said switch unit and actuating means are enclosed respectively in sealed, protective, non-magnetic metal housings.

* * * * *